US006044574A

United States Patent [19]

Haghkhah et al.

[11] Patent Number: 6,044,574

[45] Date of Patent: Apr. 4, 2000

[54] HAIR CARE STAND AND PORTABLE STORAGE CASE

[76] Inventors: Gity Haghkhah, 10874 W. Bellfort, Houston, Tex. 77099; Rohanglz Hajlsattri, 6500 Harbortown #3205, Houston, Tex. 77036

[21] Appl. No.: 09/353,956

[22] Filed: Jul. 15, 1999

[51] Int. Cl.[7] ..... F26B 23/04

[52] U.S. Cl. ..... 34/90; 34/97; 248/229.15; 248/540; 132/312; 132/314

[58] Field of Search ..... 34/90, 91, 96, 34/97, 98; 248/229.15, 229.12, 229.22, 477, 540; 108/23, 98, 147.18; 132/102, 118, 312, 314; 312/224, 226, 242, 245

[56] References Cited

U.S. PATENT DOCUMENTS

| | | | |
|---|---|---|---|
| 4,161,955 | 7/1979 | Webb | 132/9 |
| 4,466,203 | 8/1984 | Thomas | 34/99 |
| 4,736,528 | 4/1988 | Sahm | 34/98 |
| 5,313,716 | 5/1994 | Wolfe | 34/90 |
| 5,359,461 | 10/1994 | Rice et al. | 359/874 |
| 5,878,757 | 3/1999 | Hernandez | 132/287 |

*Primary Examiner*—Pamela A. Wilson

[57] ABSTRACT

A hair care stand system for providing an easily stored portable adjustable hair dryer stand having an adjustable mirror and a multi-purpose storage container includes an adjustable telescopic stand for coupling to an edge of a table, the stand having an articulated scissor arm for holding a hair dryer and a flexible mirror arm having a mirror coupled to a distal end of the mirror arm, and a bi-level storage case for holding and storing the stand, hair dryer, mirror, and associated hair dryer attachments.

9 Claims, 3 Drawing Sheets

HAIR CARE STAND AND PORTABLE STORAGE CASE

BACKGROUND OF THE INVENTION

1. Field of the Invention

The present invention relates to hair dryer stands and more particularly pertains to a new hair care stand system for providing an easily stored portable adjustable hair dryer stand having an adjustable mirror and a multi-purpose storage container.

2. Description of the Prior Art

The use of hair dryer stands is known in the prior art. More specifically, hair dryer stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,359,461; U.S. Pat. No. 4,466,203; U.S. Pat. No. 5,350,144; U.S. Pat. No. 4,161,955; U.S. Pat. No. 2,691,498; and U.S. Pat. No. Des. 261,818.

While these devices fulfill their respective, particular objectives and requirements, the aforementioned patents do not disclose a new hair care stand system. The inventive device includes an adjustable telescopic stand for coupling to an edge of a table, the stand having an articulated scissor arm for holding a hair dryer and a flexible mirror arm having a mirror coupled to a distal end of the mirror arm, and a bi-level storage case for holding and storing the stand, hair dryer, mirror, and associated hair dryer attachments.

In these respects, the hair care stand system according to the present invention substantially departs from the conventional concepts and designs of the prior art, and in so doing provides an apparatus primarily developed for the purpose of providing an easily stored portable adjustable hair dryer stand having an adjustable mirror and a multi-purpose storage container.

SUMMARY OF THE INVENTION

In view of the foregoing disadvantages inherent in the known types of hair dryer stands now present in the prior art, the present invention provides a new hair care stand system construction wherein the same can be utilized for providing an easily stored portable adjustable hair dryer stand having an adjustable mirror and a multi-purpose storage container.

The general purpose of the present invention, which will be described subsequently in greater detail, is to provide a new hair care stand system apparatus and method which has many of the advantages of the hair dryer stands mentioned heretofore and many novel features that result in a new hair care stand system which is not anticipated, rendered obvious, suggested, or even implied by any of the prior art hair dryer stands, either alone or in any combination thereof.

To attain this, the present invention generally comprises an adjustable telescopic stand for coupling to an edge of a table, the stand having an articulated scissor arm for holding a hair dryer and a flexible mirror arm having a mirror coupled to a distal end of the mirror arm, and a bi-level storage case for holding and storing the stand, hair dryer, mirror, and associated hair dryer attachments.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair care stand system apparatus and method which has many of the advantages of the hair dryer stands mentioned heretofore and many novel features that result in a new hair care stand system which is not anticipated, rendered obvious, suggested, or even implied by any of the prior art hair dryer stands, either alone or in any combination thereof.

It is another object of the present invention to provide a new hair care stand system that may be easily and efficiently manufactured and marketed.

It is a further object of the present invention to provide a new hair care stand system that is of a durable and reliable construction.

An even further object of the present invention is to provide a new hair care stand system which is susceptible of a low cost of manufacture with regard to both materials and labor, and which accordingly is then susceptible of low prices of sale to the consuming public, thereby making such hair care stand system economically available to the buying public.

Still yet another object of the present invention is to provide a new hair care stand system which provides in the apparatuses and methods of the prior art some of the advantages thereof, while simultaneously overcoming some of the disadvantages normally associated therewith.

Still another object of the present invention is to provide a new hair care stand system for providing an easily stored portable adjustable hair dryer stand having an adjustable mirror and a multi-purpose storage container.

Yet another object of the present invention is to provide a new hair care stand system which includes an adjustable telescopic stand for coupling to an edge of a table, the stand having an articulated scissor arm for holding a hair dryer and a flexible mirror arm having a mirror coupled to a distal end of the mirror arm, and a bi-level storage case for holding and storing the stand, hair dryer, mirror, and associated hair dryer attachments.

Still yet another object of the present invention is to provide a new hair care stand system that is adjustable for positioning a hair dryer and mirror leaving two hands free for combing and styling the hair. Additionally, persons having only one arm or hand are now permitted to dry their hair while combing or styling their hair.

Even still another object of the present invention is to provide a new hair care stand system that is easily stored and transported in a carrying case capable of holding the stand, a hair dryer and multiple hair care accessories.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
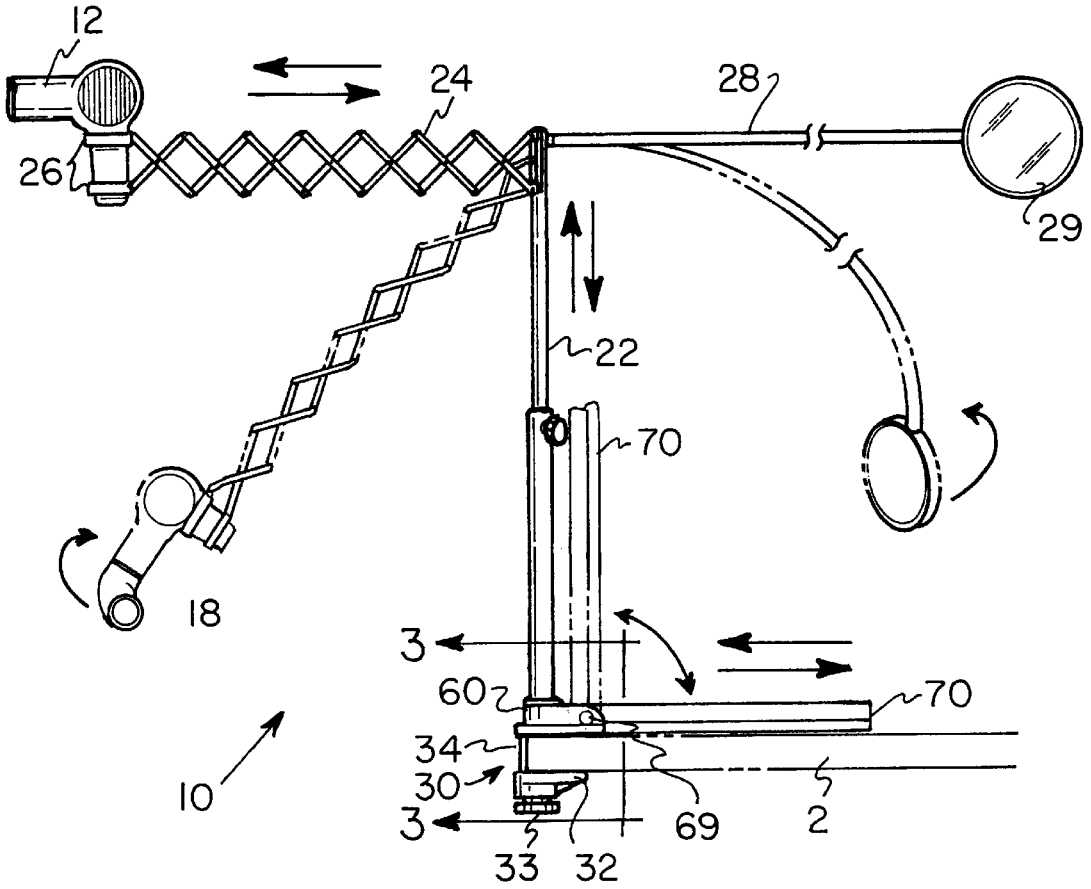
FIG. 1 is a side view of a new hair care stand system according to the present invention.
Figure 2:
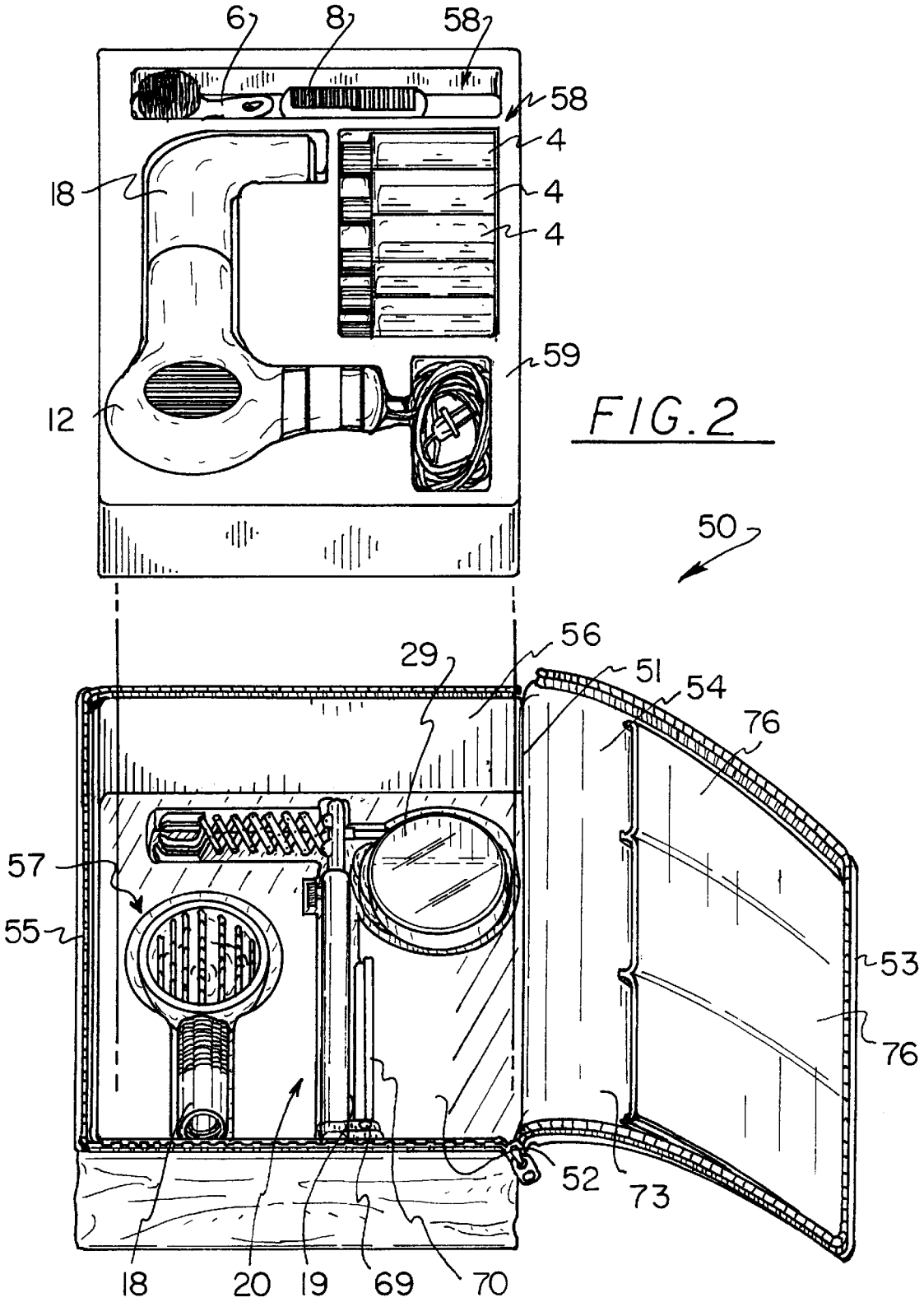
FIG. 2 is a perspective view of the storage case of the present invention.
Figure 3:
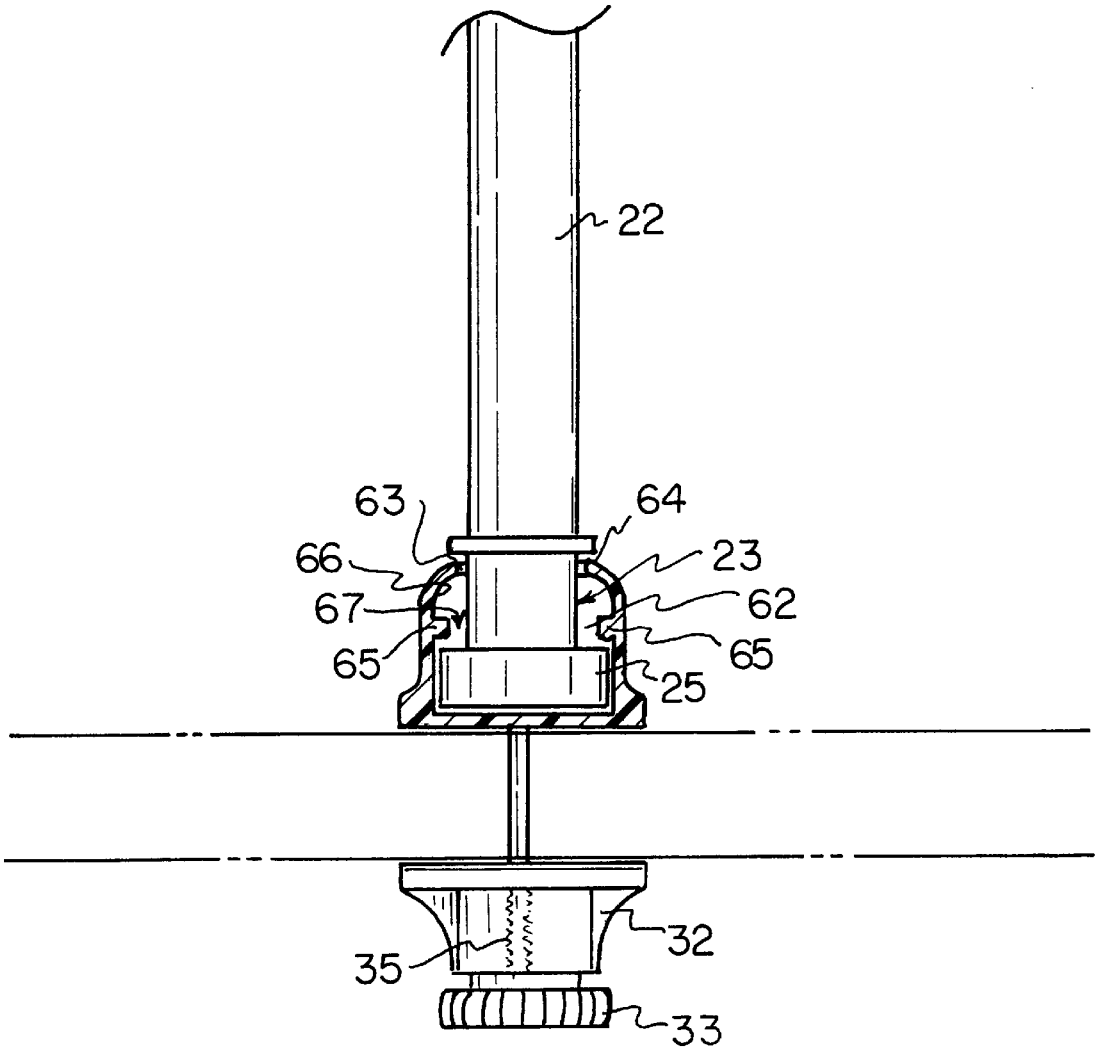
FIG. 3 is a cross-sectional view taken along line 3—3 of FIG. 1.

With reference now to the drawings, and in particular to FIGS. 1 through 3 thereof, a new hair care stand system embodying the principles and concepts of the present invention and generally designated by the reference numeral 10 will be described.

As best illustrated in FIGS. 1 through 3, the hair care stand system 10 generally comprises a hair dryer 12 and an adjustable stand 20 including a telescopic elongated post 22 coupled to a base assembly 30. The base assembly is designed for coupling to a table 2.

The stand includes an articulated scissor arm 24 coupled to the post 22 for holding the hair dryer. The scissor arm includes a pair of clips 26 extending outwardly from a distal end of the scissor arm. The clips are positioned substantially parallel to each other and in spaced relationship to each other. The hair dryer includes a handle 14 having a pair of spaced grooves 16 extending substantially parallel to each other. Each groove 16 is designed for receiving an associated one of the clips 26 such that the hair dryer is detachably coupled to the scissor arm.

The stand includes a flexible mirror arm 28 coupled to the post. The mirror arm includes a mirror 29 coupled to a distal end of the mirror arm. In an embodiment, the mirror arm is constructed of a material that is flexible and non-resilient such that the mirror arm remains in a desired position.

A bi-level storage case 50 is provided for holding and storing the stand 20, hair dryer 12, and associated hair dryer attachments 18.

The base assembly includes a lower clamp member 32, an upper clamp member 60, and a tension member 34 extending between the lower clamp member and the upper clamp member.

The tension member includes a threaded end 35 inserted into the lower clamp member. The lower clamp member includes a rotational dial 33 operationally coupled to the tension member such that rotation of the rotational dial in a selected direction extends and retracts the tension member relative to the lower clamp member. The tension member is fixedly coupled to the upper clamp member such that rotation of the rotational dial varies a gap between the upper clamp member and the lower clamp member. Thus the upper and lower clamp member are adjustable relative to each other to engage the base assembly to a table 2.

The upper clamp member is generally oblong extending transversely to the elongated post. The upper clamp member is also configured to have an interior chamber 62 and a slot 63 extending along a length of an upper face 64 of the upper clamp member. The interior chamber includes a pair of opposed elongate protrusions 65, each of the elongate protrusions extending away from an interior wall 66 of the interior chamber a finite length into the interior chamber. The elongate protrusions are aligned for providing a gap 67 therebetween. The elongate protrusions extend along a length of the interior chamber.

The elongated post is positioned to have a base end 23 opposite the mirror arm. The base end is inserted into the slot of the upper clamp member and through the gap between the elongate protrusions. The base end includes a lip 25 extending outwardly from the elongated post, the lip having a diameter greater than a length of the gap 67 between the elongate protrusions such that the elongated post is coupled to the upper clamp member and permitted to slide along a length of the upper clamp member.

In an embodiment, the upper clamp member includes joint 69 such that a distal extent 70 of the upper clamp member is pivotable to a position substantially parallel to the elongated post when the elongated post is positioned proximate the tension member.

The bi-level storage case includes a bottom 52, a top 54, and a perimeter wall 56 extending between the bottom and the top. A connection portion 51 of the top and the perimeter wall is integrally joined along one side of the perimeter wall to form a living hinge. Free portions 53 and 55 of the top and the perimeter wall respectively are selectively couplable to each other for closing the storage case.

The bottom includes a plurality of depressions 57 for receiving the hair dryer attachments 18. The depressions include a stand depression 19 configured for receiving the stand therein such that the stand is securely held with the stand depression.

The storage case includes a removable tray 59 having a plurality of tray depressions 58 therein designed for holding a plurality of hair care products 4, a brush 6, a comb 8, and the hair dryer. In an embodiment, the top includes a plurality of pockets 76 coupled to an interior face 73 of the top.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hair care stand system comprising:

a hair dryer;

an adjustable stand having an elongated post coupled to a base assembly, said base assembly being adapted for coupling to a table;

said stand having an articulated scissor arm coupled to said post, said articulated scissor arm being for holding said hair dryer;

said stand having a flexible mirror arm coupled to said post, said mirror arm having a mirror coupled to a distal end of the mirror arm; and a bi-level storage case for holding and storing said stand, hair dryer, and associated hair dryer attachments.

2. The hair care stand system of claim 1, further comprising:

said base assembly having a lower clamp member, an upper clamp member, and a tension member extending between said lower clamp member and said upper clamp member;

said tension member having a threaded end inserted into said lower clamp member, said lower clamp member including a rotational dial operationally coupled to said tension member such that rotation of said rotational dial in a selected direction extends and retracts said tension member relative to said lower clamp member;

said tension member being fixedly coupled to said upper clamp member whereby rotation of said rotational dial varies a gap between said upper clamp member and said lower clamp member.

3. The hair care stand system of claim 2, further comprising:

said upper clamp member being generally oblong extending transversely to said elongated post, said upper clamp member being configured to have an interior chamber and a slot extending along a length of an upper face of said upper clamp member;

said interior chamber having a pair of opposed elongate protrusions, each of said elongate protrusions extending away from an interior wall of said interior chamber a finite length into said interior chamber, said elongate protrusions being aligned for providing a gap therebetween, said elongate protrusions extending along a length of said interior chamber;

said elongated post being positioned to have a base end opposite said mirror arm, said base end being inserted into said slot of said upper clamp member through said gap between said elongate protrusions, said base end having a lip extending outwardly from said elongated post, said lip having a diameter greater than a length of said gap between said elongate protrusions whereby said elongated post is slidably coupled to said upper clamp member.

4. The hair care stand system of claim 3, wherein said upper clamp member is jointed such that a distal extent of said upper clamp member is pivotable to a position substantially parallel to said elongated post when said elongated post is positioned proximate said tension member.

5. The hair care stand system of claim 1, further comprising:

said bi-level storage case having a bottom and a top and a perimeter wall extending between said bottom and said top, a connection portion of said top and said perimeter wall being integrally joined along one side to form a living hinge, free portions of said top and said perimeter wall being selectively couplable to each other for closing said storage case;

said bottom having a plurality of depressions therein for receiving said hair dryer accessories therein, said depressions including a stand depression being configured for receiving said stand therein such that said stand is securely held with said stand depression;

said storage case including a removable tray, said tray having a plurality of tray depressions therein adapted for holding a plurality of hair care products, a brush, a comb, and said hair dryer.

6. The hair care stand system of claim 5, wherein said top includes a plurality of pockets coupled to an interior face of said top.

7. The hair care stand system of claim 1, further comprising:

said scissor arm having a pair of clips extending outwardly from a distal end of said scissor arm, said clips being positions substantially parallel to each other and in spaced relationship to each other;

said hair dryer including a handle, said handle having a pair of spaced grooves extending substantially parallel to each other, each groove being for receiving an associated one of said clips such that said hair dryer is detachably coupled to said scissor arm.

8. The hair care stand system of claim 1 wherein said elongated post is telescopic.

9. A hair care stand system comprising:

a hair dryer;

an adjustable stand having a telescopic elongated post coupled to a base assembly, said base assembly being adapted for coupling to a table;

said stand having an articulated scissor arm coupled to said post, said articulated scissor arm being for holding said hair dryer;

said stand having a flexible mirror arm coupled to said post, said mirror arm having a mirror coupled to a distal end of the mirror arm;

a bi-level storage case for holding and storing said stand, hair dryer, and associated hair dryer attachments;

said base assembly having a lower clamp member, an upper clamp member, and a tension member extending between said lower clamp member and said upper clamp member;

said tension member having a threaded end inserted into said lower clamp member, said lower clamp member including a rotational dial operationally coupled to said tension member such that rotation of said rotational dial in a selected direction extends and retracts said tension member relative to said lower clamp member;

said tension member being fixedly coupled to said upper clamp member whereby rotation of said rotational dial varies a gap between said upper clamp member and said lower clamp member;

said upper clamp member being generally oblong extending transversely to said elongated post, said upper clamp member being configured to have an interior chamber and a slot extending along a length of an upper face of said upper clamp member;

said interior chamber having a pair of opposed elongate protrusions, each of said elongate protrusions extending away from an interior wall of said interior chamber a finite length into said interior chamber, said elongate protrusions being aligned for providing a gap therebetween, said elongate protrusions extending along a length of said interior chamber;

said elongated post being positioned to have a base end opposite said mirror arm, said base end being inserted into said slot of said upper clamp member through said gap between said elongate protrusions, said base end having a lip extending outwardly from said elongated post, said lip having a diameter greater than a length of said gap between said elongate protrusions whereby said elongated post is slidably coupled to said upper clamp member;

wherein said upper clamp member is jointed such that a distal extent of said upper clamp member is pivotable to a position substantially parallel to said elongated post when said elongated post is positioned proximate said tension member;

said bi-level storage case having a bottom and a top and a perimeter wall extending between said bottom and said top, a connection portion of said top and said perimeter wall being integrally joined along one side to form a living hinge, free portions of said top and said perimeter wall being selectively couplable to each other for closing said storage case;

said bottom having a plurality of depressions therein for receiving said hair dryer attachments therein, said depressions including a stand depression being configured for receiving said stand therein such that said stand is securely held with said stand depression;

said storage case including a removable tray, said tray having a plurality of tray depressions therein adapted for holding a plurality of hair care products, a brush, a comb, and said hair dryer;

wherein said top includes a plurality of pockets coupled to an interior face of said top;

said scissor arm having a pair of clips extending outwardly from a distal end of said scissor arm, said clips being positions substantially parallel to each other and in spaced relationship to each other; and said hair dryer including a handle, said handle having a pair of spaced grooves extending substantially parallel to each other, each groove being for receiving an associated one of said clips such that said hair dryer is detachably coupled to said scissor arm.

* * * * *